US007741549B2

(12) United States Patent
Espinosa Ferrando

(10) Patent No.: US 7,741,549 B2
(45) Date of Patent: Jun. 22, 2010

(54) METHOD OF PRODUCING PARTS FOR WOODWIND AND BRASS MUSICAL INSTRUMENTS USING BRIARWOOD

(76) Inventor: Francisco Espinosa Ferrando, c/Juan Ramón Jiménez, 5, E-13580 Almodovar Del Campo, Ciudad Real (ES)

( * ) Notice: Subject to any disclaimer, the term of this patent is extended or adjusted under 35 U.S.C. 154(b) by 39 days.

(21) Appl. No.: 11/992,952

(22) PCT Filed: Oct. 21, 2005

(86) PCT No.: PCT/ES2005/000562

§ 371 (c)(1),
(2), (4) Date: Apr. 2, 2008

(87) PCT Pub. No.: WO2007/045698

PCT Pub. Date: Apr. 26, 2007

(65) Prior Publication Data

US 2009/0126552 A1 May 21, 2009

(51) Int. Cl.
*G10D 9/02* (2006.01)

(52) U.S. Cl. ..... 84/383 A; 84/383 R; 84/398

(58) Field of Classification Search ..... 84/383 A, 84/383 R, 398; 131/328
See application file for complete search history.

(56) References Cited

U.S. PATENT DOCUMENTS 2,890,614 A * 6/1959 Fearn ..... 84/398

3,494,368 A * 2/1970 Keenan ..... 131/328

OTHER PUBLICATIONS

International Search Report issued Mar. 1, 2006 in the International (PCT) Application of which the present application is the U.S. National Stage.

Gaita de Fole, "Gaita de Fole (Zamora)", Mar. 2, 2002. [online] [retrieved on Feb. 21, 2006]. Retrieved on the Internet: <URL: http://usuarios.lycos.es/Aqueron/fole.htm, pp. 1-10. See p. 1, foot of photograph and p. 2, text and foot of photograph.

Infomadera, "Pipas de Madera", Mar. 26, 2005. [online] [retrieved on Feb. 21, 2006]. <URL: http://informadera.net/images/l1610.pdf. See on p. "19", p. "20", col. 1, 'Secado de los esbozos' and p. "22", col. 2, lines 1-5.

De los Ministriles a la Big-Band, "Visita Virtual-Materiales Didácticos", May 2001. [online] [retrieved on Feb. 21, 2006]. Retrieved on the Internet: <URL: http://www.fundac-juandeborbon.com/expo/expo.pdf, pp. 1-22. See p. 19, 'Materiales' and p. 20, 'Maderas'.

* cited by examiner

*Primary Examiner*—Jianchun Qin
(74) *Attorney, Agent, or Firm*—Wenderoth, Lind & Ponack L.L.P.

(57) ABSTRACT

The invention relates to a method of producing parts for woodwind and brass musical instruments using briarwood, either from the root or branch thereof, said wood being kept moist from the moment it is cut until it is boiled in water for 16 hours, dried in anaerobic conditions and cured under cover for at least six months and for up to two or more years. The following parts can be thus produced: mouthpiece, tongue, clarinet barrel, flute head or bell. The aforementioned parts, which are not affected by humidity, better produce and carry the sound. In addition, a wide range of sounds is possible, such as jazz, classical, soloist, orchestra and band.

6 Claims, 8 Drawing Sheets

Fig. 1
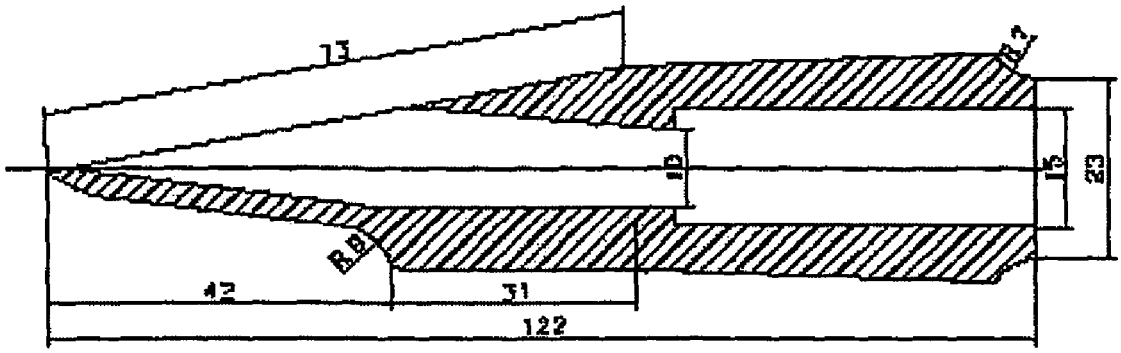
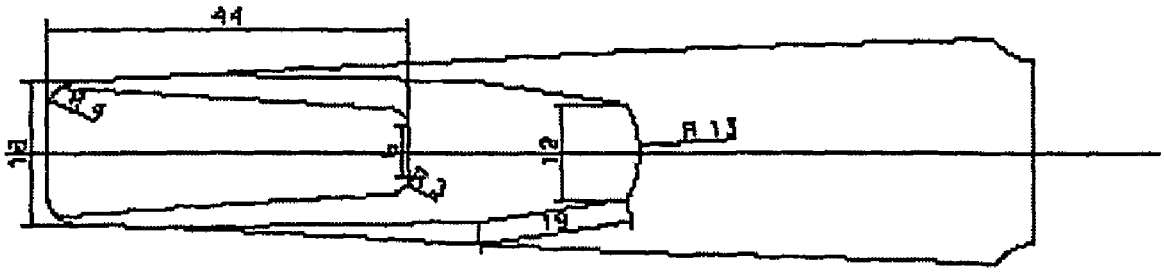
Fig. 2

METHOD OF PRODUCING PARTS FOR WOODWIND AND BRASS MUSICAL INSTRUMENTS USING BRIARWOOD

BACKGROUND OF THE INVENTION

I. Field of Invention

The present invention relates to a mouthpiece of the type used in woodwind and brass-wind musical instruments and other components of those instruments.

The present invention concerns mouthpiece manufacture in root and branch of briar boiled and dried in different duration, and 6 months of curing, up to two years and more than two years, with a waxed finish, for the coupling thereof in any woodwind and brass-wind musical instrument, accordingly, in addition to other components of those instruments, manufactured in the same material.

II. Description of Related Art

The mouthpiece, fundamental component of the musical instruments treated herein, is used in the saxophone, clarinet, transverse flute, recorder, etc., for the production of sound by forced conduction of the air expelled by the player into the body of the instrument. Both in the woodwind and brass-wind instruments the practice is to use mouthpieces of ebonite in diverse shapes and sizes, in terms of the pitch and tone it is sought to obtain.

The only advantage that is obtained with the ebonite mouthpiece is the specialty of its sound, jazz, classic, etc., obtained with standard different measures of opening and depth of the mouthpiece.

In spite of that advantage, ebonite mouthpieces have certain disadvantages. For example; they can cause allergy problems; their changeability for excessive cold or heat, which produces mistuning of the instrument; excessive taste and smell of a synthetic product; excessive diversity in opening and depth measurements of the mouthpieces for the production of different pitches, which entails a certain difficulty for a proper selection and excessive effort from the players for producing the sound, more so for beginners. With reference to the sound, this does not manage to be as enveloping and balanced as could be desired, producing very irregular waves in the same note, of different length and depth, at the same time as undesirable harmonics.

SUMMARY OF THE INVENTION

The mouthpiece herein disclosed is manufactured in a single size for each type of instrument, in briar wood, either root, or branch thereof, moistened from the extraction or cutting thereof until its boiling in water, for 16 hours; drying under anaerobic conditions for a minimum period of 6 months and cured under cover, in normal environmental conditions, for 6 months, up to two years and more than two years, with a final wax-based finish. It goes without saying that the longer the curing time, the better the sound quality.

The invention provides a mouthpiece and other components of the aforementioned instruments that are unalterable, unaffected by humidity and do not suffer from expansion or contraction. It also provides a natural hard high-density product, and therefore a better producer and conductor of sound and at the same time flexible, a most appreciated characteristic in the reeds which produces a natural and enveloping sound, and what is greatly appreciated by the musicians, that a given mouthpiece, or reed, in the event, with minimum effort, facilitates a wide range of sounds, jazz, classic, soloist, orchestra and band.

To complete the description of the invention and the scope thereof, the descriptive specification is accompanied with a set of drawings and the graphical transcript of the natural musical notes, DOH, RAY, ME, FAH, SOH, LAH, TE, obtained from the same tenor saxophone, using an ebonite mouthpiece and a briar mouthpiece for the comparison thereof.

BRIEF DESCRIPTION OF THE DRAWINGS

FIG. 1. shows an inverted profile of the tenor saxophone mouthpiece.

FIG. 2. shows the plan view of the same mouthpiece.

DETAILED DESCRIPTION OF THE INVENTION

Figure 3:
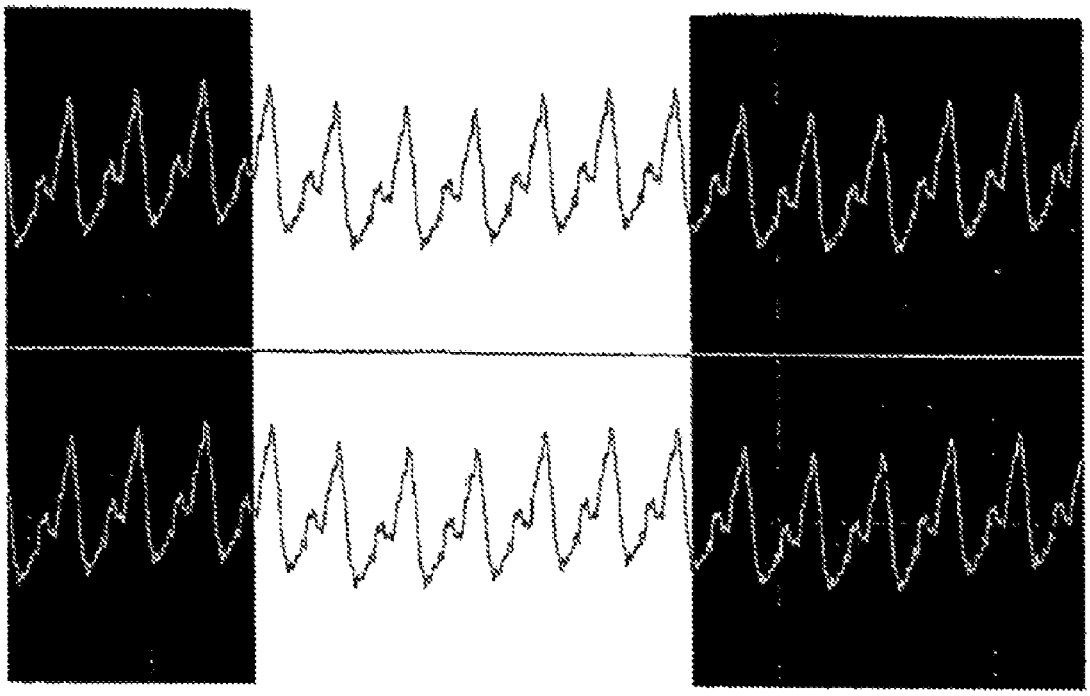
FIG. 3 represents a transcription of note DOH for an ebonite mouthpiece
Figure 4:
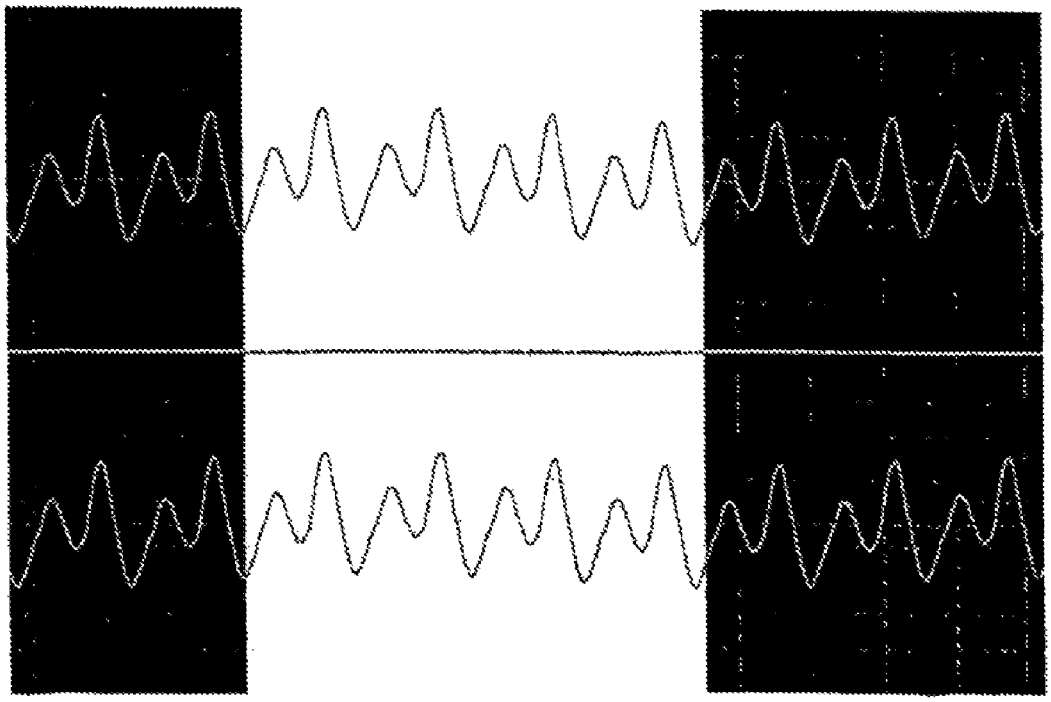
FIG. 4 represents a transcription of note DOH for a briar mouth piece.
Figure 5:
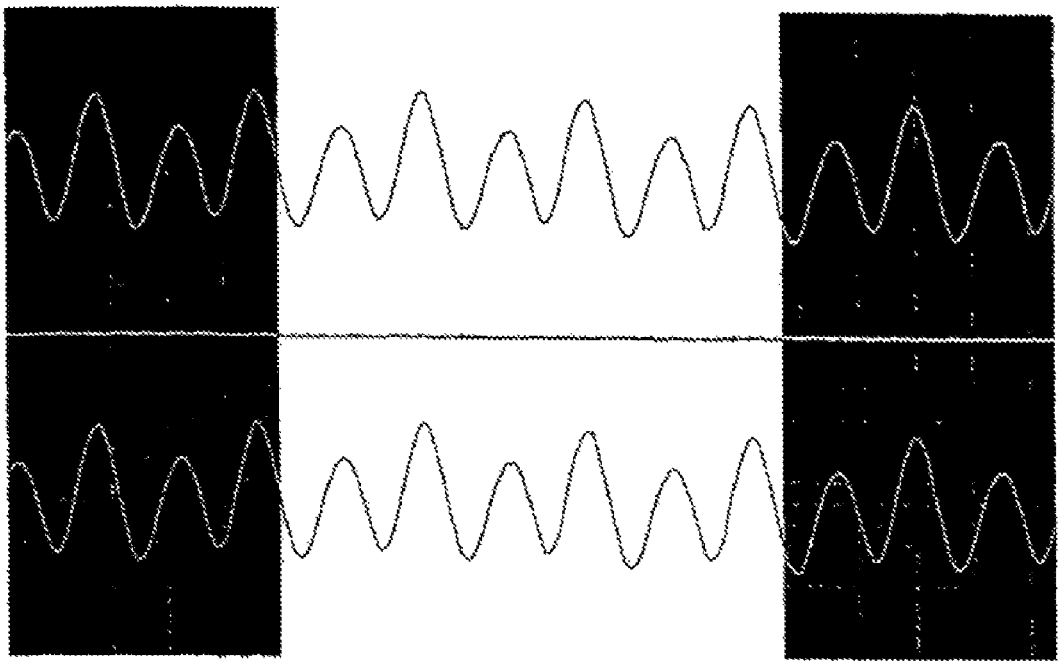
FIG. 5 represents a transcription of note RAY for an ebonite mouthpiece
Figure 6:
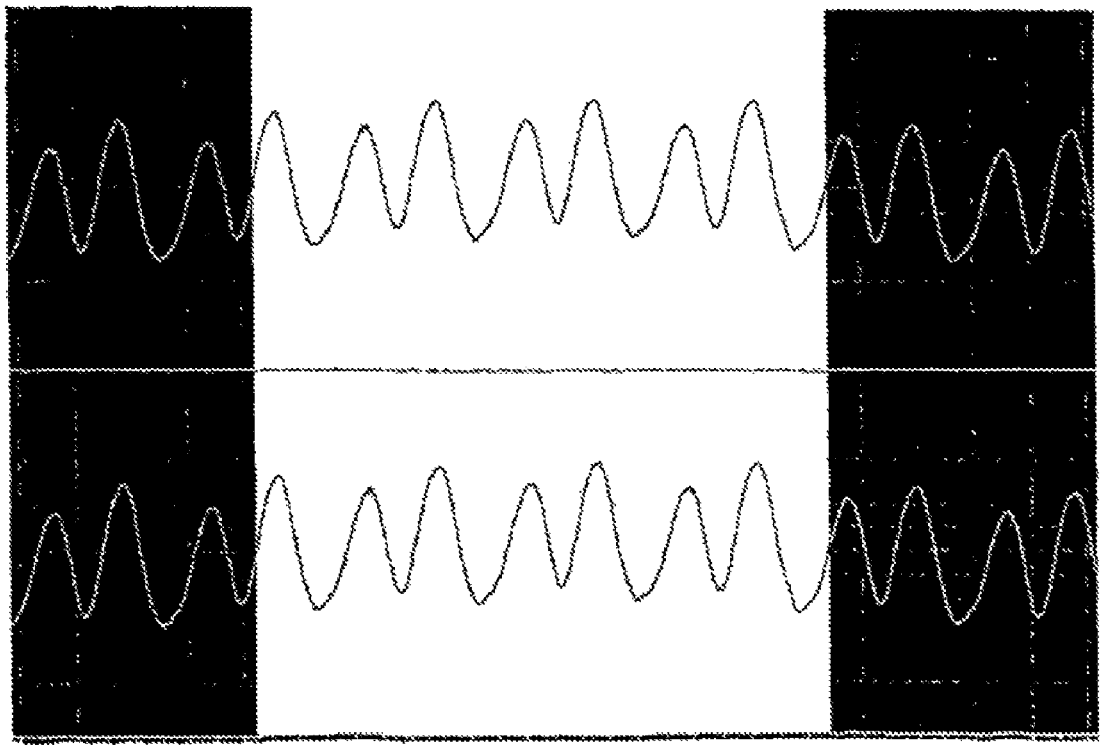
FIG. 6 represents a transcription of note RAY for a briar mouth piece.
Figure 7:
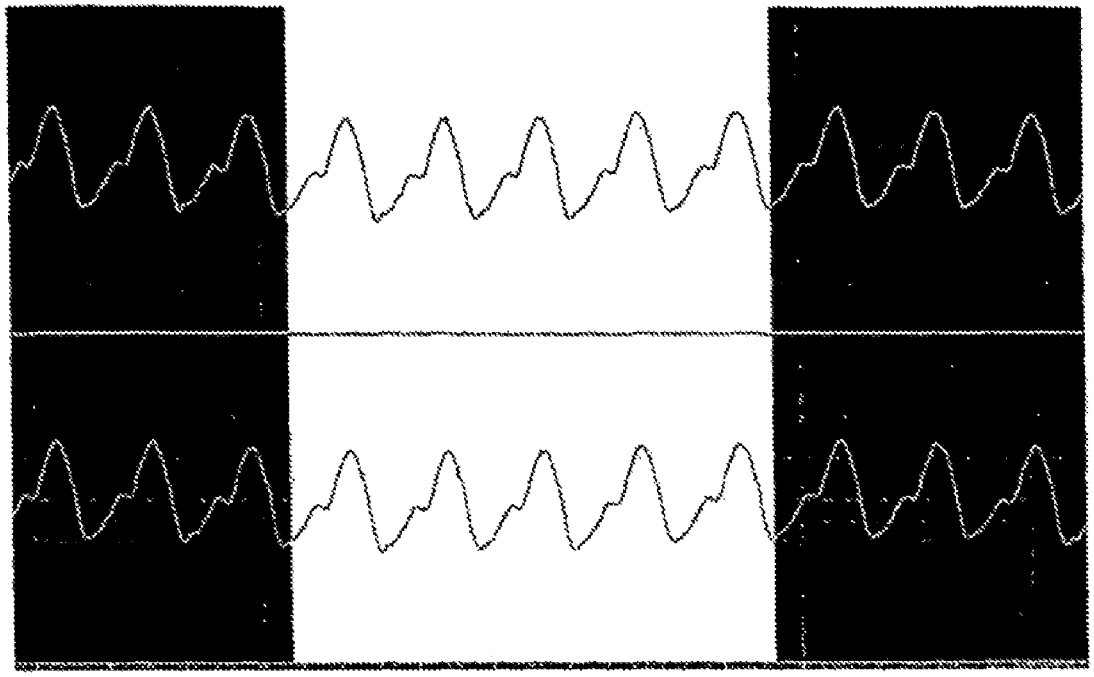
FIG. 7 represents a transcription of note ME for an ebonite mouthpiece
Figure 8:
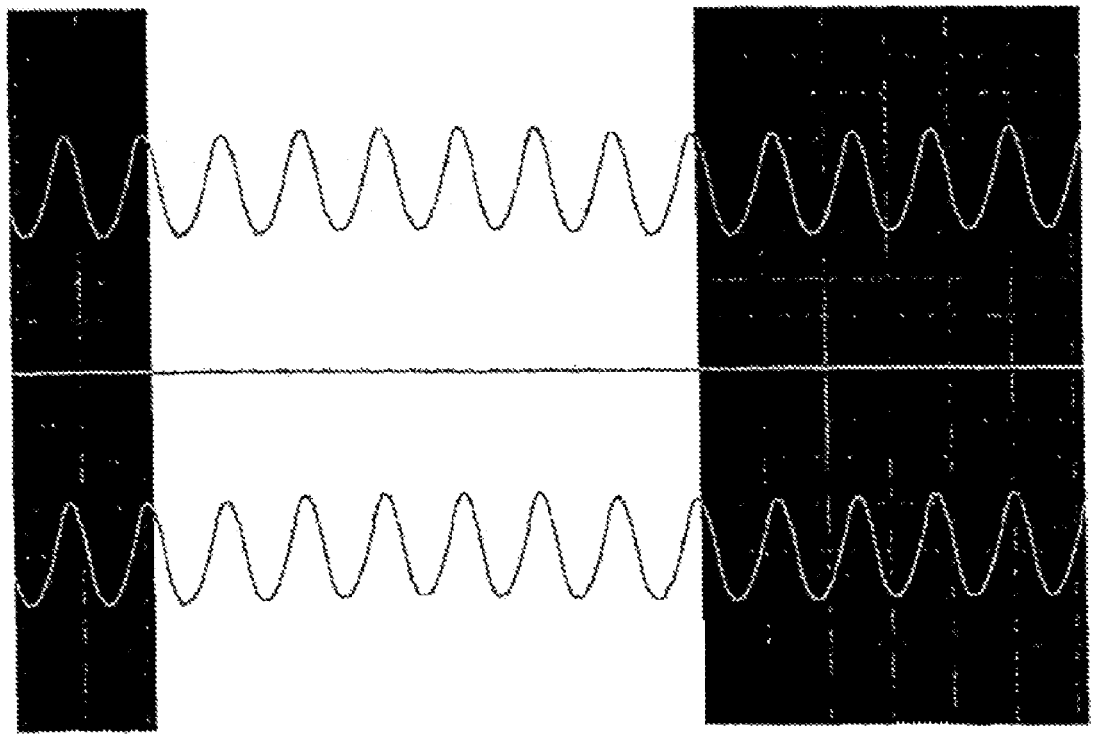
FIG. 8 represents a transcription of note ME for a briar mouth piece.
Figure 9:
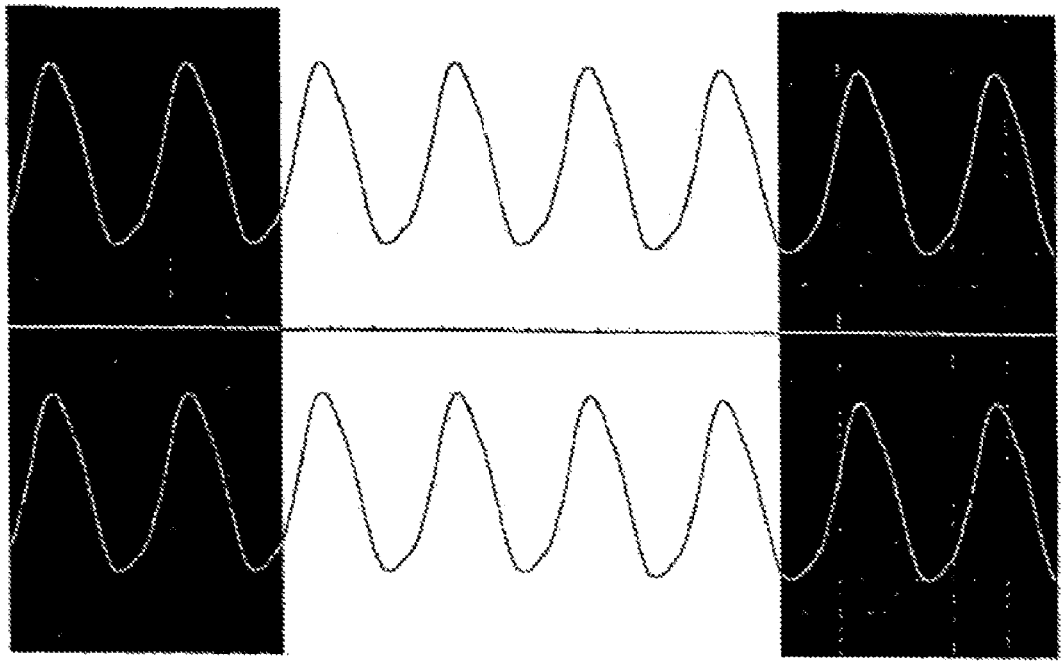
FIG. 9 represents a transcription of note FAH for an ebonite mouthpiece
Figure 10:
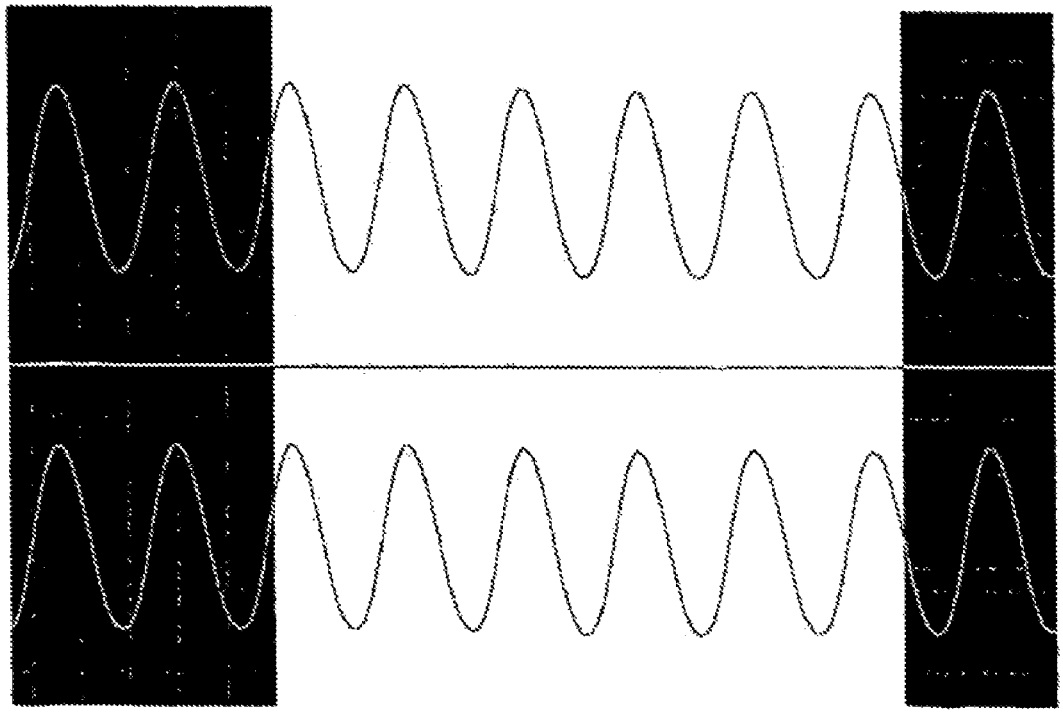
FIG. 10 represents a transcription of note FAH for a briar mouth piece.
Figure 11:
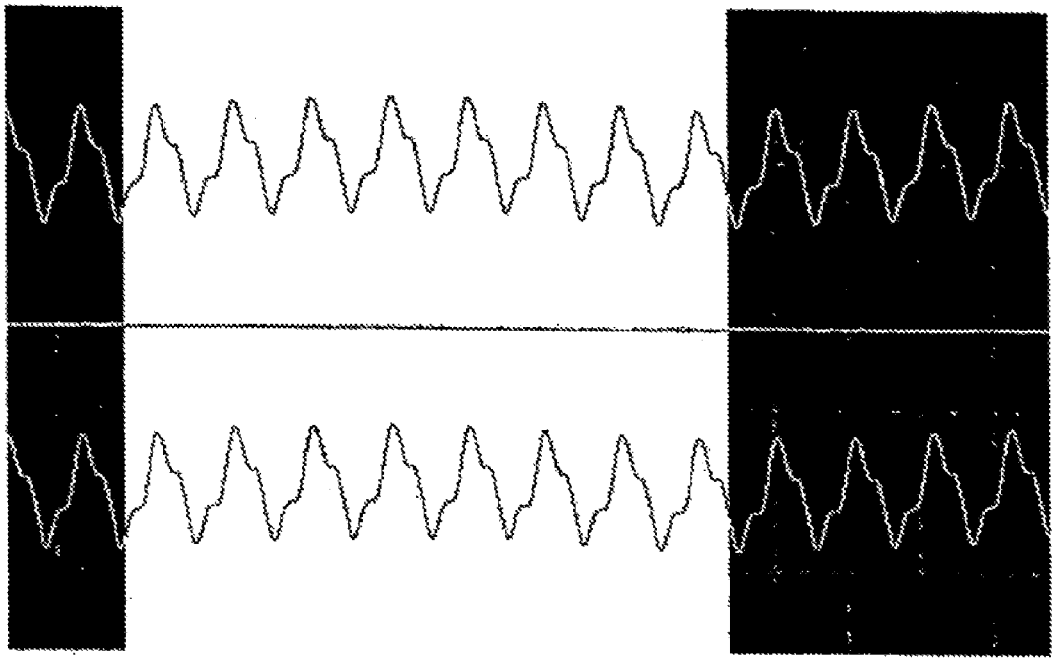
FIG. 11 represents a transcription of note SOH for an ebonite mouthpiece
Figure 12:
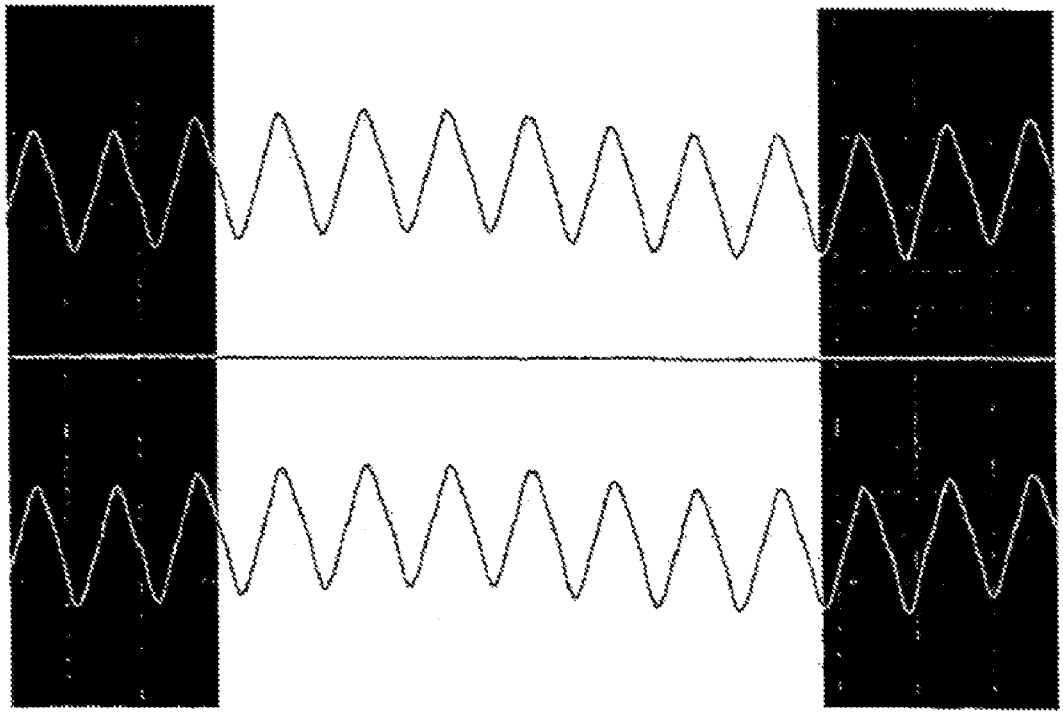
FIG. 12 represents a transcription of note SOH for a briar mouth piece.
Figure 13:
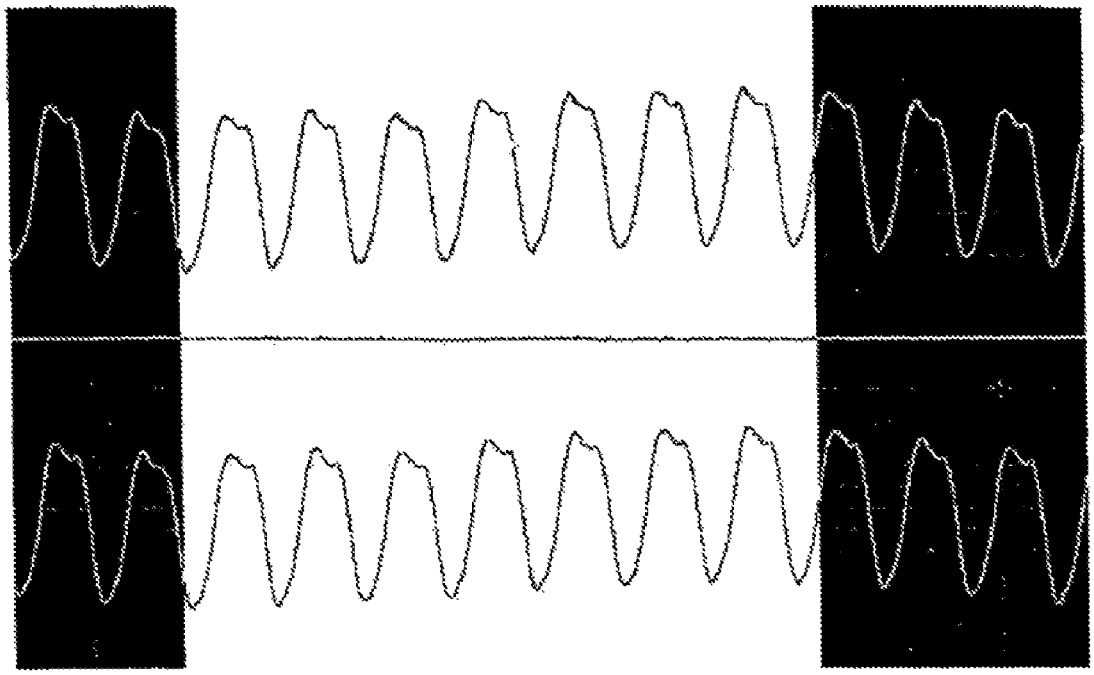
FIG. 13 represents a transcription of note LAH for an ebonite mouthpiece
Figure 14:
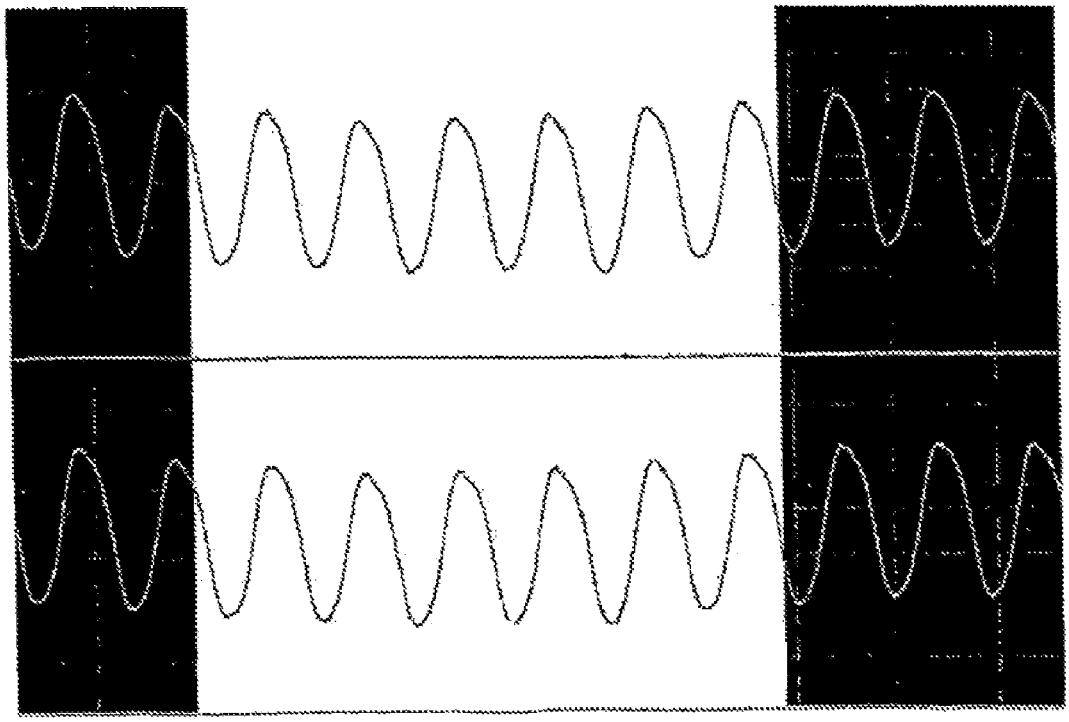
FIG. 14 represents a transcription of note LAH for a briar mouth piece.
Figure 15:
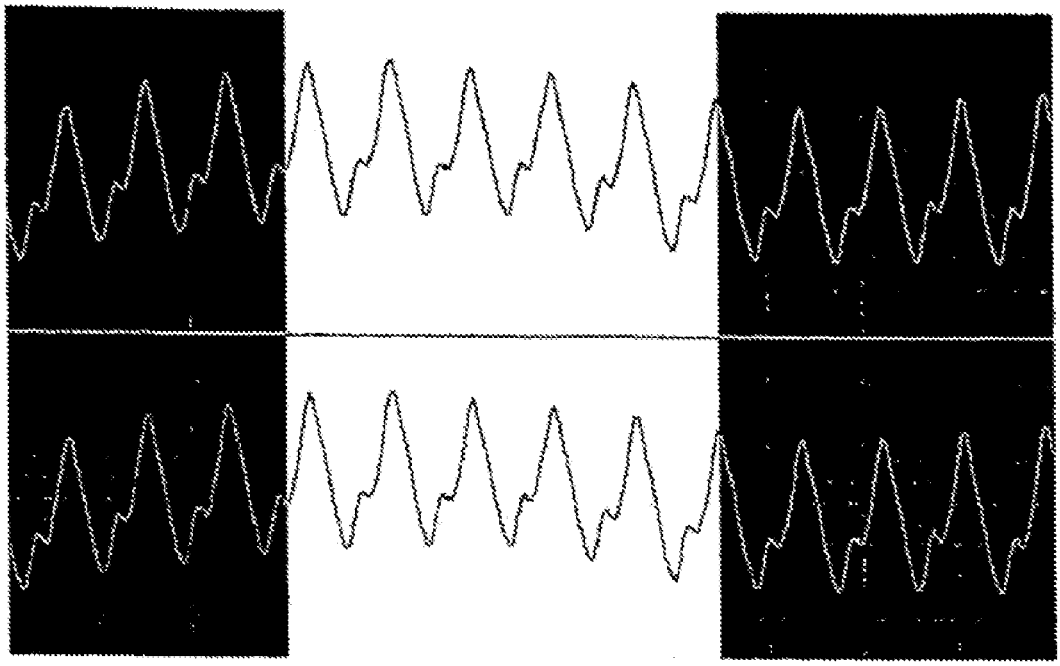
FIG. 15 represents a transcription of note TE for an ebonite mouthpiece
Figure 16:
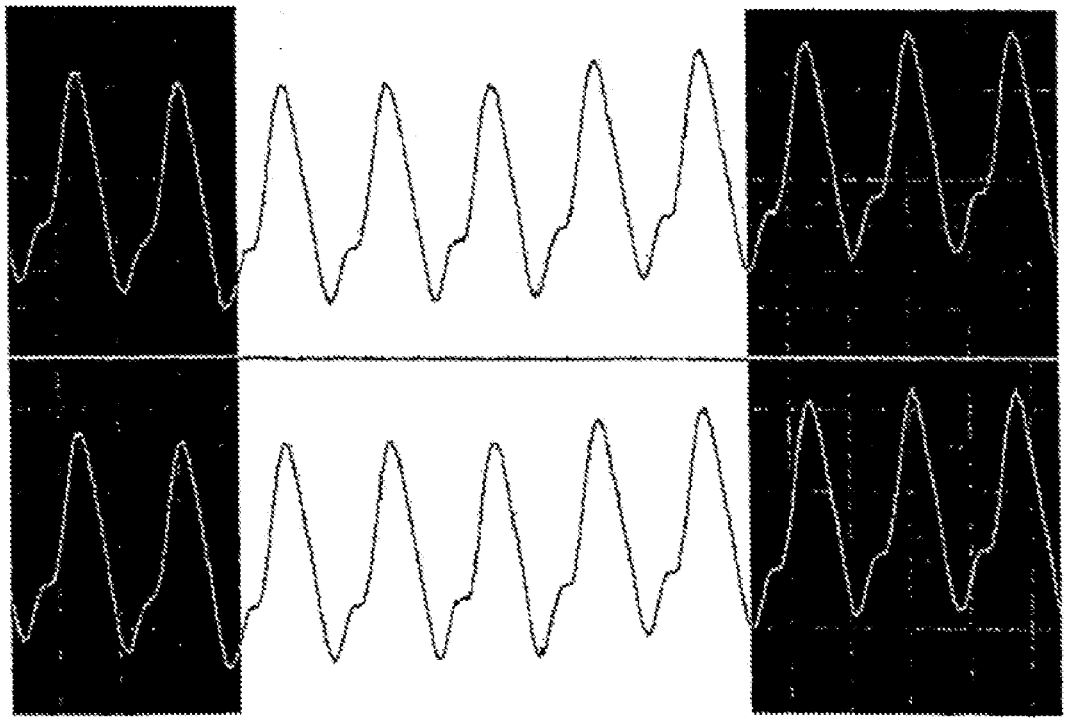
FIG. 16 represents a transcription of note TE for a briar mouth piece.

The length of this mouthpiece is between 6 and 10 mm more than the length of the range of tenor saxophone mouthpieces. And the thickness is between 0.1 and 0.2 mm more than the thickness of those mentioned.

As for the comparative study, it can be observed in the transcript of the note DOH, page 2, the waves in this note, produced with an ebonite mouthpiece offer a clearly toothed appearance, with more marked differences in the amplitude of the waves. However, with the briar mouthpiece, although offering the same succession of waves of different amplitude, in no way is the appearance sawtoothed and the difference in the amplitude of the wave pairs is less perceptible.

In the comparison of the note RAY, page 3, although no notable differences are perceived between the notes produced by the different mouthpieces, it can be appreciated that the regularity of the amplitude of the wave pairs is more accused with the briar mouthpiece.

In the transcript of the note ME, page 4, although the wave is less toothed with the ebonite mouthpiece than the note DOH, with the briar mouthpiece it attains a purity and regularity in sound, comparable with that of the tuning fork.

As it can be observed in the transcript of the note FAH, page 5, although the ebonite mouthpiece improves with regard to the other notes, with the briar mouthpiece perfection is almost reached in the proportionality between the wave length and amplitude.

From the mere observation of the note SOH, page 6, the difference in sound is clearly deduced, much more regular with the briar mouthpiece, without that toothed aspect of the wave corresponding to the ebonite mouthpiece.

And this is how the note LAH, page 7, is observed for the ebonite mouthpiece, in the upper part of the wave it is shown toothed, which does not occur with the briar mouthpiece which surpasses the former in regularity.

And to conclude with the note TE, page 8, here the differences in wave morphology are less perceptible, although the difference in wave amplitude gives an idea of a substantial difference as regards the sound range amplitude.

The invention claimed is:

1. A method of manufacturing a part of woodwind and brass-wind musical instruments using briar wood, root or branch, comprising:

cutting briar wood, root or branch, moistening the cutting cut briar wood, root or branch, after moistening the cut briar wood, root or branch, boiling the cut briar wood, root or branch in water, for 16 hours, drying the cut briar wood, root or branch in anaerobic conditions, under a cover, curing the cut briar wood, root or branch in normal environmental conditions for a minimum period of six months, up to two years or more than two years, and applying a final wax-based finish, wherein the part can be a mouthpiece, a reed, a small barrel, a bell or a flute head.

2. A method according to claim 1, wherein the part is a mouthpiece configured to be coupled to a woodwind or brass-wind musical instrument.

3. A method according to claim 1, wherein the part is a reed configured to be coupled to a woodwind or brass-wind musical instrument.

4. A method according to claim 1, wherein the part is a small barrel configured to be coupled to a clarinet.

5. A method according to claim 1, wherein the part is a bell configured to be coupled to a clarinet.

6. A method according to claim 1, wherein the part is a flute head.

* * * * *